US009385417B2

(12) United States Patent
Lin

(10) Patent No.: US 9,385,417 B2
(45) Date of Patent: Jul. 5, 2016

(54) BROADBAND ANTENNA AND WIRELESS COMMUNICATION DEVICE EMPLOYING SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 199 days.

(21) Appl. No.: 14/065,595

(22) Filed: Oct. 29, 2013

(65) Prior Publication Data

US 2014/0191908 A1 Jul. 10, 2014

(30) Foreign Application Priority Data

Jan. 9, 2013 (TW) ..... 102100667 A

(51) Int. Cl.
*H01Q 1/24* (2006.01)
*H01Q 13/16* (2006.01)
*H01Q 5/371* (2015.01)

(52) U.S. Cl.
CPC ..... *H01Q 1/243* (2013.01); *H01Q 5/371* (2015.01); *H01Q 13/16* (2013.01)

(58) Field of Classification Search
None
See application file for complete search history.

(56) References Cited

U.S. PATENT DOCUMENTS 8,552,919 B2 * 10/2013 Hsieh et al. ..... 343/833
2008/0106478 A1 * 5/2008 Hill ..... 343/702

* cited by examiner

*Primary Examiner* — Robert Karacsony
(74) *Attorney, Agent, or Firm* — ScienBiziP, P.C.

(57) ABSTRACT

A broadband antenna is mounted in a metal piece and includes a radiating portion, a ground portion, and a feed portion. The radiating portion includes a main portion and a plurality of radiating arms extending from the main portion in multiple directions, the radiating arms extend to contact the metal piece. The main portion, the radiating arms, and the metal piece enclose several slots. The ground portion is connected to a plurality of end portions of the radiating arms. The feed portion is connected to the metal piece and is adjacent to the radiating portion. The feed portion, the ground portion, the main portion, and the plurality of radiating arms form different current paths, thus to form different resonance nodes, thereby tender the broadband antenna to work at multi frequency bands. A wireless communication device employing the broadband antenna is also described.

4 Claims, 5 Drawing Sheets

BROADBAND ANTENNA AND WIRELESS COMMUNICATION DEVICE EMPLOYING SAME

BACKGROUND

1. Technical Field

The present disclosure relates to a broadband antenna and a wireless communication device employing the broadband antenna.

2. Description of Related Art

An antenna is used for transceiving wireless signals in a wireless communication device, such as a mobile phone or a personal digital assistant. The wireless communication device needs to transmit and receive wireless signals at different frequencies to meet different communication system standards. A metal housing is applied for the wireless communication device for strength and heat dissipating. However, the antenna may be affected by a shielding effect of the metal housing. Therefore, the antenna is designed in the limited space of the metal housing and needs to overcome the affection of the metal housing, meanwhile transceiving multi-band frequency wireless signals. There is room for improvements in the art.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
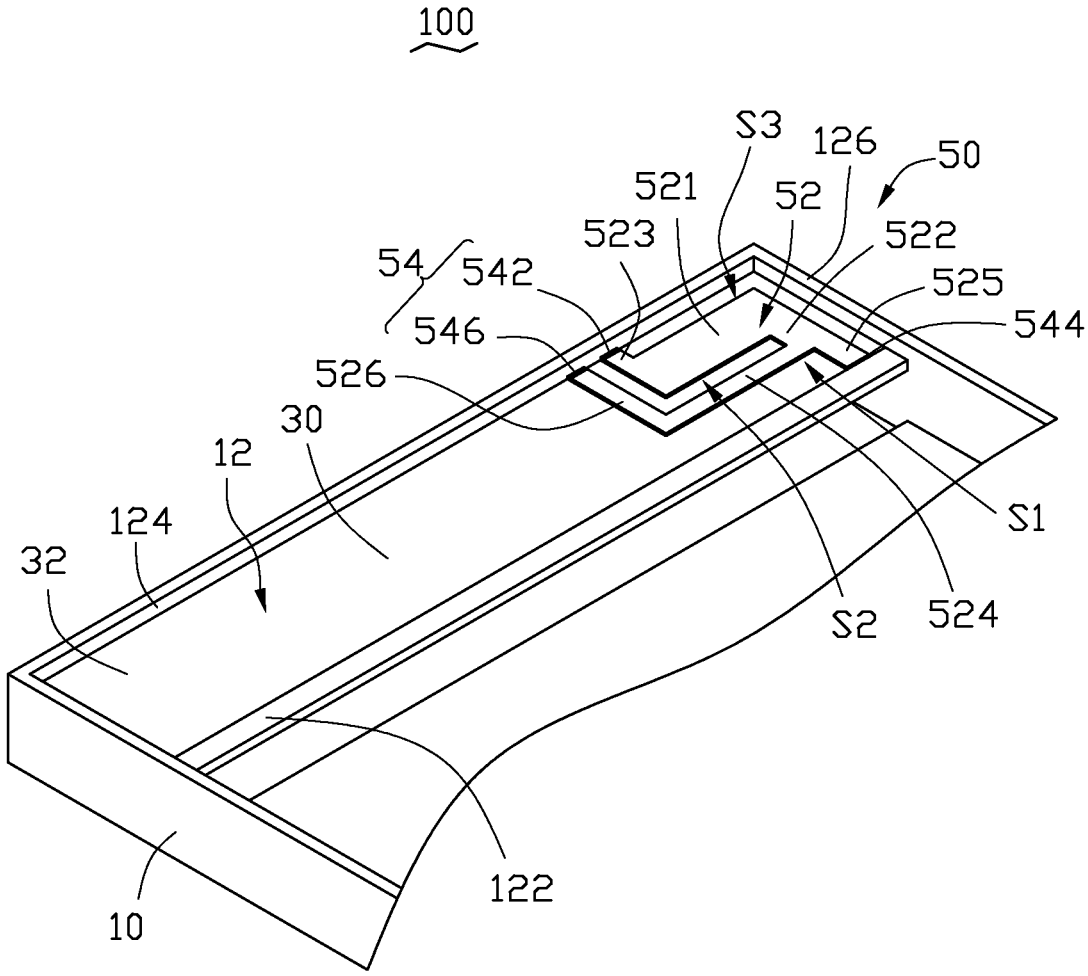
FIG. 1 is an isometric view of an exemplary embodiment of a wireless communication device having a broadband antenna.

FIG. 1 shows an exemplary embodiment of a wireless communication device 100. The wireless communication device 100 has a broadband antenna 50. The broadband antenna 50 is used for transmitting and receiving wireless signals at multi-frequency bands. The wireless communication device 100 can be a mobile phone or a tablet computer, for example.

The wireless communication device 100 includes a metal piece 10, a circuit board 30, and the broadband antenna 50. The circuit board 30 is mounted in the housing 10. The broadband antenna 50 is mounted on and is electrically connected to the circuit board 30, which is used for transmitting signals therebetween.

Figure 2:
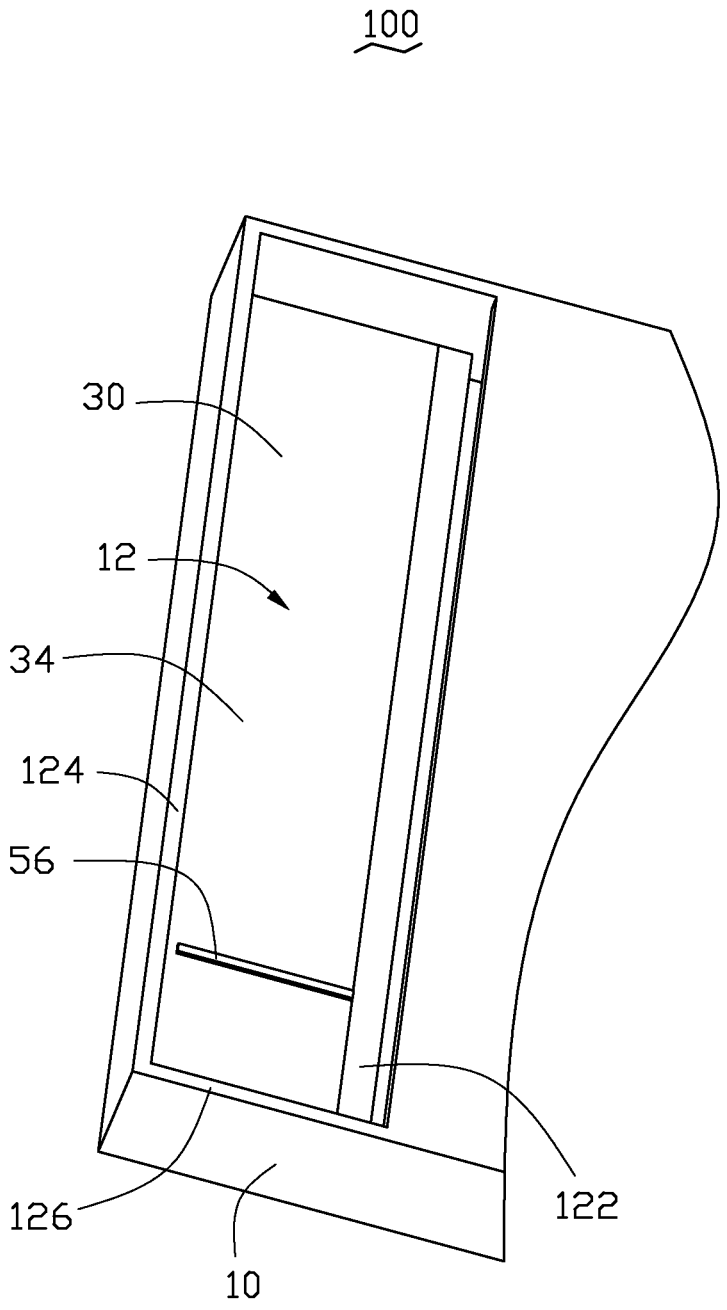
FIG. 2 is another isometric view of the wireless communication device of FIG. 1.

FIGS. 1 and 2 show that the metal piece 10 is annular shaped and defines a rectangular hole 12 in a central portion. In the exemplary embodiment, the metal piece 10 may be a housing of the wireless communication device 100, such as an external housing or an internal housing. The hole 12 includes a first sidewall 122, a second sidewall 124 opposite to the first sidewall 122, and a third sidewall 126 connecting the first sidewall 122 and the second sidewall 124.

The circuit board 30 is mounted in the hole 12, and may be a carrier for the broadband antenna 50. The circuit board 30 includes a first surface 32 and a second surface 34 opposite to the first surface 32.

The broadband antenna 50 includes a radiating portion 52, a ground portion 54, and a feed portion 56. The radiating portion 52 and the ground portion 54 are mounted on the first surface 32, and the ground portion 54 is connected to an end of the radiating portion 52. The feed portion 56 is mounted on the second surface 34.

The radiating portion 52 includes a main portion 521, a connecting arm 522, a first radiating arm 523, a second radiating arm 524, a third radiating arm 525, and a fourth radiating arm 526. The main portion 521 is a rectangular sheet. The connecting arm 522 and the first radiating arm 523 are perpendicularly extending from two vertical angles of the main portion 521 in opposite directions. The connecting arm 522 and the first radiating arm 523 are both rectangular sheets. The first radiating arm 523 extends to contact the metal piece 10.

The second radiating arm 524 is perpendicularly extending from an end of the connecting arm 522 away from the main portion 521, and the second radiating arm 524 is parallel to main portion 521 and defines a space. The second radiating arm 524 is a rectangular strip, which has a narrower width and a greater length than that the main portion 521. The third radiating arm 525 and the fourth radiating arm 526 are perpendicularly extended from opposite ends of the second radiating arm 524 in opposite directions, and extend to contact the first sidewall 122 and the second sidewall 124 respectively. The third radiating arm 525 is a rectangular sheet and in a same direction with the connecting arm 522. The fourth radiating arm 526 is a rectangular strip and is parallel to the first radiating arm 523. The second radiating arm 524, the third radiating arm 525, and the first sidewall 122 form a first slot S1. The first radiating arm 523, the main portion 521, the connecting arm 522, the second radiating arm 524, the fourth radiating arm 526, and the second sidewall 124 form a second slot S2. The first radiating arm 523, the main portion 521, the connecting arm 522, the third radiating arm 525, the first sidewall 122, the third sidewall 126, and the second sidewall 124 form a third slot S3.

The ground portion 54 includes a first ground point 542, a second ground point 544, and a third ground point 546. The first ground point 542 is arranged on an end of the first radiating arm 523 away from the main portion 521. The second ground point 544 is arranged on an end of the third radiating arm 525 away from the second radiating arm 524. The third ground point 546 is arranged on an end of the fourth radiating arm 526 away from the second radiating arm 524. The first ground point 542, the second ground point 544, and the third ground point 546 are electrically connected to a ground portion of the circuit board 30, thus grounding the broadband antenna 50.

The feed portion 56 is rectangular strip shaped and is parallel to the fourth radiating arm 526. The feed portion 56 is electrically connected to the first sidewall 122 of the metal piece 10 and the circuit board 30 for transmitting signals between the broadband antenna 50 and the circuit board 30.

The broadband antenna 50 feeds current signals via the feed portion 56 from the circuit board 30, the feed portion 56, the metal piece 10, the main portion 521, the connecting arm 522, and the plurality of radiating arms form current paths with different length, tender the broadband antenna 50 generates different resonance nodes, thus to achieve wide frequency band. In the exemplary embodiment, the broadband antenna 50 is capable of transmitting and receiving wireless signals at a central frequency of about 1530 megaHertz (MHz) to about 2320 MHz, thus the broadband antenna 50 can work in the GPS and diversity band 1/2/4 frequency bands, thereby applied for multi high frequency communication system.

Figure 3:
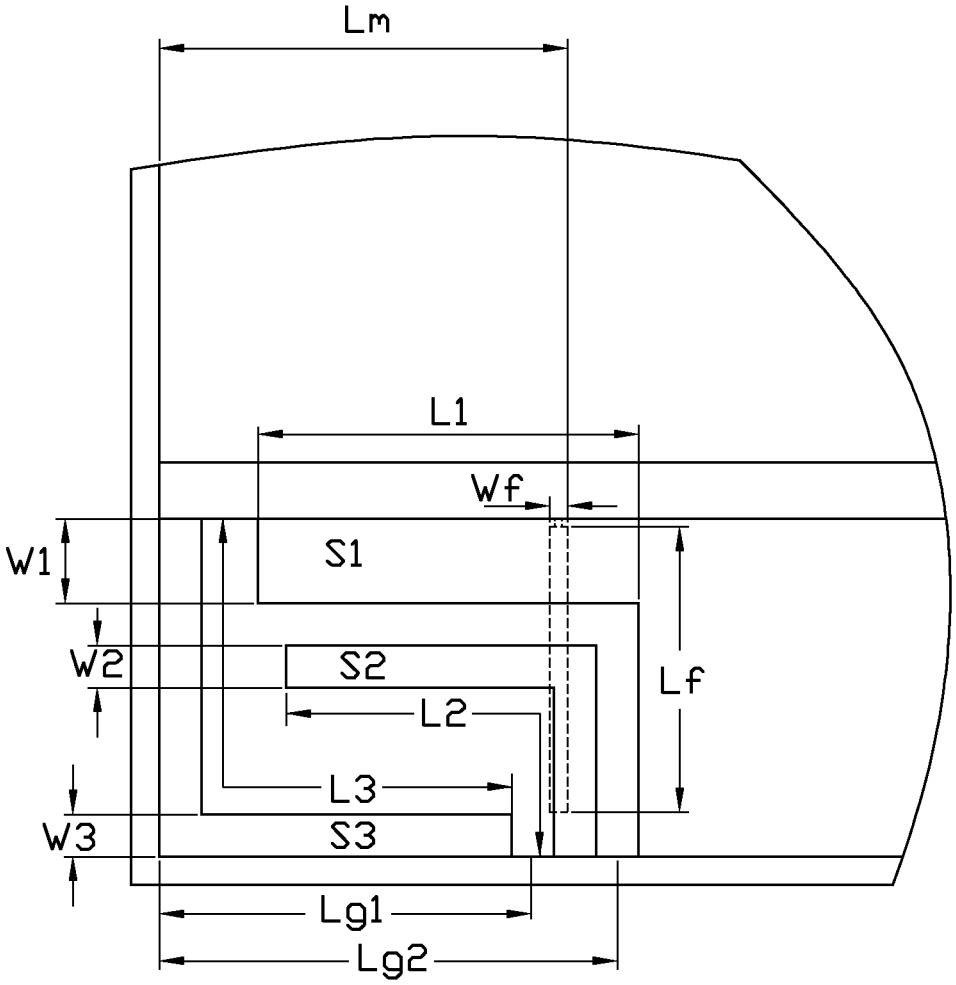
FIG. 3 is a plane view of the broadband antenna of FIG. 1.

FIG. 3 shows that a length of the first slot S1 is L1 (which is equal to a length of an external side of the second radiating arm 524). A width of the first slot S1 is W1 (which is equal to a length of an internal side of the third radiating arm 525, same as a vertical distance between the second radiating arm 524 and the first sidewall 122). A length of the second slot S2 is L2 (which is equal to a total length of the first radiating arm 523 and an internal side of the main portion 521, same as a total length of a vertical distance between the connecting arm 522 and the fourth radiating arm 526, and a vertical distance between the second radiating arm 524 and the second sidewall 124). A width of the second slot S2 is W2 (which is equal to a length of the connecting arm 522, same as a vertical distance between the second radiating arm 524 and the main portion 521). A length of the third slot S3 is L3 (which is equal to a total length of a length of an external side of the main portion 521, a length of the connecting arm 522, a width of the second radiating arm 524, and a length of the third radiating arm 525). A width of the third slot S3 is W3 (which is equal to a length of first radiating arm 523, same as a vertical distance between the main portion 521 and the second sidewall 124). A length of the feed portion 56 is Lf and a width is Wf. A length between the feed portion 56 and the third sidewall 126 is Lm. A length between the first ground point 542 and the third sidewall 126 is Lg1, a length between the third ground point 546 and the third sidewall 126 is Lg2. A return loss and a radiating efficiency of the broadband antenna 50 at different frequency bands can be adjusted by adjusting the foresaid parameters, thus to achieve wide frequency band and better radiating efficiency. In the exemplary embodiment, when L1=13.5 mm, W1=3 mm, L2=17 mm, W2=1.5 mm, L3=22 mm, W3=1.5 mm, Lf=10 mm, Wf=0.6 mm, Lm=14 mm, Lg1=13 mm, and Lg2=16 mm, the broadband antenna 50 achieves wide frequency band and better radiating efficiency at a central frequency of about 1530 MHz to about 2320 MHz.

Figure 4:
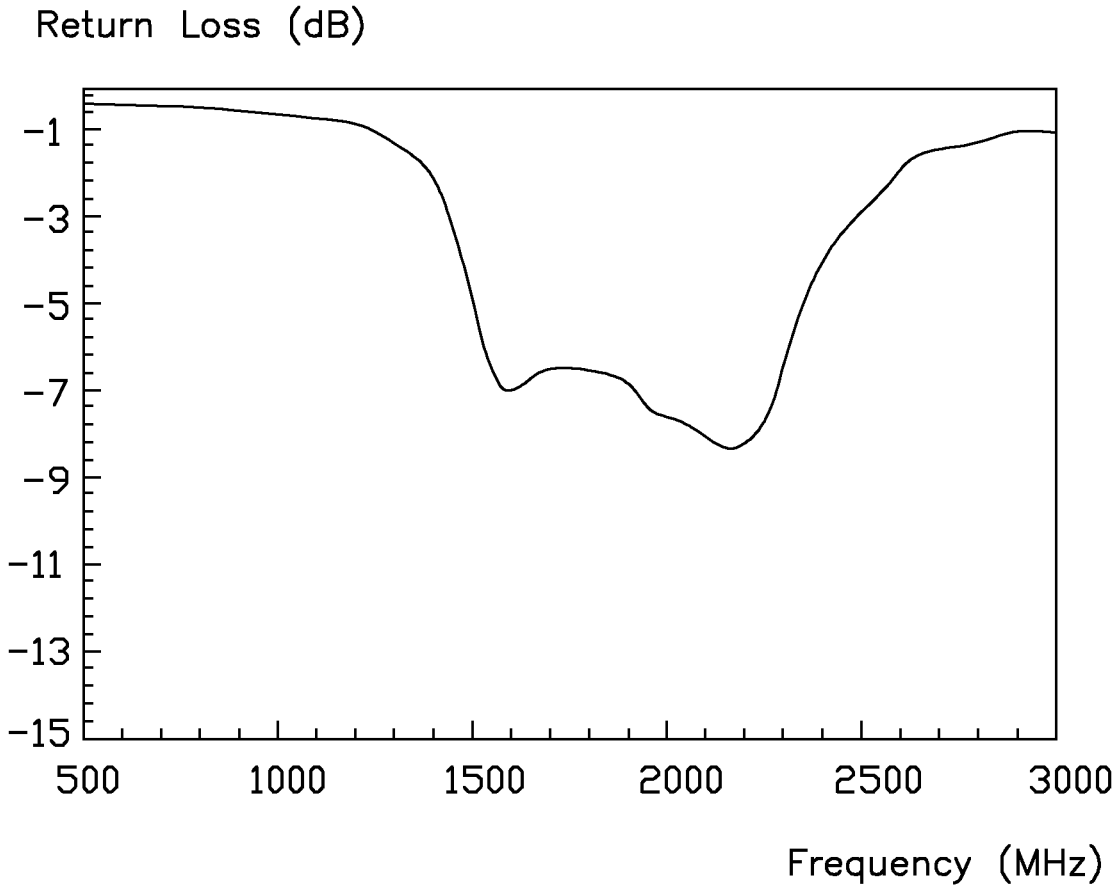
FIG. 4 is a return loss diagram of the broadband antenna of the wireless communication device of FIG. 1.

FIG. 4 shows a return loss diagram of the broadband antenna 50, which showing the broadband antenna 50 meets working standards at frequency band of at about 1530 MHz to about 2320 MHz.

Figure 5:
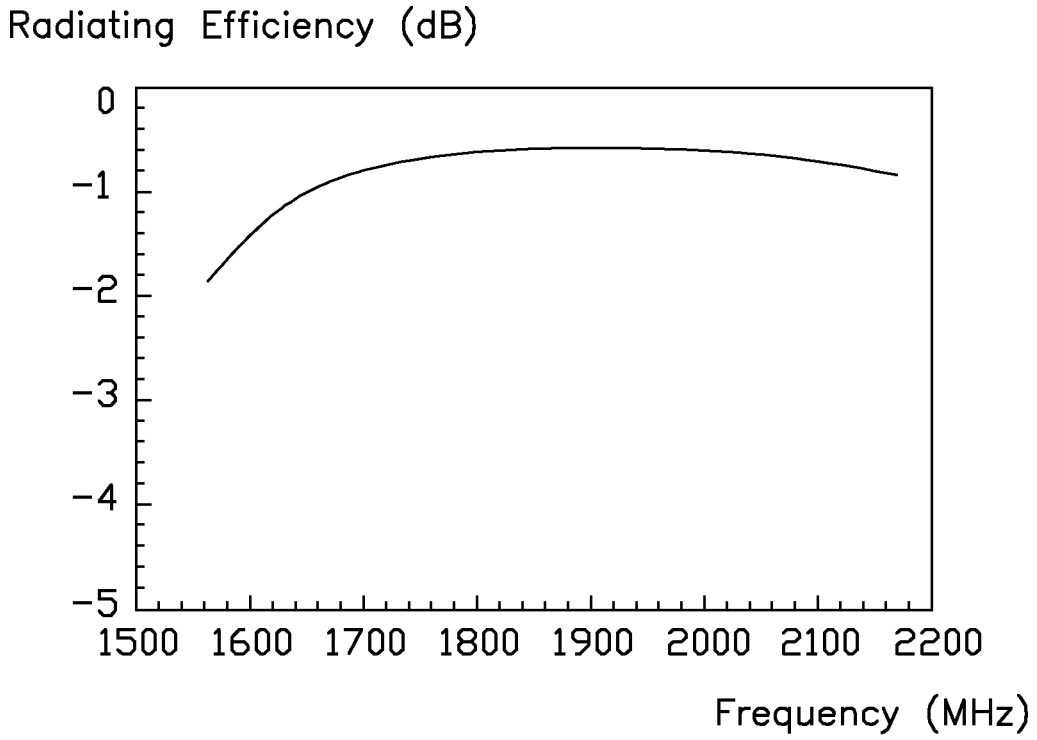
FIG. 5 is a radiating efficiency diagram of the broadband antenna of the wireless communication device of FIG. 1.

FIG. 5 shows a radiating efficiency diagram of the broadband antenna 50, which showing the broadband antenna 50 achieves high radiating efficiency at frequency band of at about 1530 MHz to about 2320 MHz.

The wireless electronic device 100 has the broadband antenna 50 mounted in the metal piece 10. The radiating portion 52 and the feed portion 56 extend to contact the metal piece 10, and the plurality of radiating arms of the radiating portion 52 and the sidewalls of the metal piece 10 enclose several slots, which allow the broadband antenna 50 to work at broader frequency bands. In addition, the broadband antenna 50 is mounted in the hole 12 defined by the metal piece 10, which is simple structure and keeps the broadband antenna feature while keeping a complete appearance.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A broadband antenna mounted in a metal piece, the metal piece being annular shaped and defining a rectangular hole with sidewalls, the broadband antenna comprising:

a radiating portion including a main portion, a first radiating arm, a connecting arm, a second radiating arm, a third radiating arm and a fourth radiating arm; the first radiating arm and the connecting arm perpendicularly extended from the main portion in opposite directions; the second radiating arm perpendicularly extended from an end of the connecting arm away from the main portion and parallel to the main portion; the third radiating arm and the fourth radiating arm perpendicularly extended from opposite ends of the second radiating arm in opposite directions, the fourth radiating arm parallel to the first radiating arm; the first radiating arm, the third radiating arm and the fourth radiating arm extending to contact the sidewalls of the metal piece; the main portion, the radiating arms, and the metal piece enclosing several slots;

a ground portion configured for grounding the broadband antenna and comprising a first ground point, a second ground point and a third ground point, the first ground point, the second ground point, and the third ground point are arranged on ends of the first radiating arm, the third radiating arm, and the fourth radiating arm, respectively; and a feed portion connected to the metal piece and parallel to the fourth radiating arm, the feed portion electrically connected to a circuit board and configured for transmitting signals between the broadband antenna and the circuit board;

wherein the radiating portion, the ground portion, and the feed portion are mounted on the circuit board, the feed portion, the ground portion, the main portion, and the plurality of radiating arms form different current paths, thus to form different resonance nodes, thereby the broadband antenna works at multi frequency bands;

wherein the radiating portion and the ground portion are mounted on a first surface of the circuit board, and the feed portion is mounted on a second surface of the circuit board opposite the first surface;

wherein the hole comprises a first sidewall, a second sidewall opposite to the first sidewall, and a third sidewall connecting the first sidewall and the second sidewall, the broadband antenna is mounted in the hole; the first radiating arm extends to contact the second sidewalk; and wherein the second radiating arm, the third radiating arm, and the first sidewall enclose a first slot; the first radiating arm, the main portion, the connecting arm, the second radiating arm, the fourth radiating arm, and the second sidewall enclose a second slot; the first radiating arm, the main portion, the connecting arm, the third radiating arm, the first sidewall, the third sidewall, and the second sidewall enclose a third slot.

2. The broadband antenna as claimed in claim 1, wherein the feed portion is electrically connected to the first sidewall.

3. A wireless communication device, comprising:

a metal piece being annular shaped and defining a rectangular hole with sidewalls;

a circuit board mounted in the metal piece; and a broadband antenna mounted on the circuit board, the broadband antenna comprising:

a radiating portion including a main portion, a first radiating arm, a connecting arm, a second radiating arm, a third radiating arm and a fourth radiating arm; the first radiating arm and the connecting arm perpendicularly extended from the main portion in opposite directions; the second radiating arm perpendicularly extended from an end of the connecting arm away from the main portion and parallel to the main portion; the third radiating arm and the fourth radiating arm perpendicularly extended from opposite ends of the second radiating arm in opposite directions, the fourth radiating arm parallel to the first radiating arm; the first radiating arm, the third radiating arm and the fourth radiating arm extending to contact the sidewalls of the metal piece; the main portion, the radiating arms, and the metal piece enclosing several slots;

a ground portion configured for grounding the broadband antenna and comprising a first ground point, a second ground point and a third ground point, the first ground point, the second ground point, and the third ground point are arranged on ends of the first radiating arm, the third radiating arm, and the fourth radiating arm, respectively; and a feed portion connected to the metal piece and parallel to the fourth radiating arm, the feed portion electrically connected to a circuit board and configured transmitting signals between the broadband antenna and the circuit board;

wherein the radiating portion, the ground portion, and the feed portion are mounted on the circuit board, the feed portion, the ground portion, the main portion, and the plurality of radiating arms form different current paths, thus to form different resonance nodes, thereby the broadband antenna works at multi frequency bands;

wherein the radiating portion and the ground portion are mounted on a first surface of the circuit board, and the feed portion is mounted on a second surface of the circuit board opposite the first surface;

wherein the hole comprises a first sidewall, a second sidewall opposite to the first sidewall, and a third sidewall connecting the first sidewall and the second sidewall, the broadband antenna is mounted in the hole; the first radiating arm extends to contact the second sidewalk; and wherein the second radiating arm, the third radiating arm, and the first sidewall enclose a first slot the first radiating arm, the main portion, the connecting arm, the second radiating arm, the fourth radiating arm, and the second sidewall enclose a second slot the first radiating arm, the main portion, the connecting arm, the third radiating arm, the first sidewall, the third sidewall, and the second sidewall enclose a third slot.

4. The wireless communication device as claimed in claim 3, wherein the feed portion is electrically connected to the first sidewall.

* * * * *